US007639273B2

(12) United States Patent
Hamada et al.

(10) Patent No.: US 7,639,273 B2
(45) Date of Patent: Dec. 29, 2009

(54) IMAGE FORMING APPARATUS

(75) Inventors: Takatoshi Hamada, Toyokawa (JP); Makoto Obayashi, Toyokawa (JP); Masayuki Iijima, Okazaki (JP); Yoshikazu Watanabe, Toyohashi (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 0 days.

(21) Appl. No.: 12/198,548

(22) Filed: Aug. 26, 2008

(65) Prior Publication Data

US 2008/0317504 A1 Dec. 25, 2008

Related U.S. Application Data

(62) Division of application No. 11/497,360, filed on Aug. 2, 2006, now Pat. No. 7,432,943.

(30) Foreign Application Priority Data

Nov. 28, 2005 (JP) ..... 2005-342917

(51) Int. Cl.
*G03G 15/01* (2006.01)
*B41J 2/447* (2006.01)
*B41J 2/47* (2006.01)

(52) U.S. Cl. ..... 347/235; 347/250

(58) Field of Classification Search ..... 347/232, 347/233, 235, 250

See application file for complete search history.

(56) References Cited

U.S. PATENT DOCUMENTS

| | | | | |
|---|---|---|---|---|
| 6,163,334 | A | 12/2000 | Irie et al. | |
| 6,188,419 | B1 | 2/2001 | Katamoto et al. | |
| 6,317,245 | B1 | 11/2001 | Hama et al. | |
| 6,453,139 | B2 | 9/2002 | Sasame et al. | |
| 6,856,338 | B2 | 2/2005 | Takahashi et al. | |
| 6,930,700 | B2 * | 8/2005 | Kimura | 347/234 |
| 2006/0164504 | A1 * | 7/2006 | Kobayashi et al. | 347/233 |
| 2006/0209167 | A1 | 9/2006 | Shiraishi | |

FOREIGN PATENT DOCUMENTS

| | | |
|---|---|---|
| CN | 200410102149.7 | 6/2005 |
| JP | 11-287964 | 10/1999 |
| JP | 2001-324688 | 11/2001 |
| JP | 2004-9349 | 1/2004 |
| JP | 2005-199708 | 7/2005 |

OTHER PUBLICATIONS

An Office Action issued in the corresponding Chinese Patent Application No. 200610128851.X, dated May 16, 2008, and translation thereof.

* cited by examiner

*Primary Examiner*—Huan H Tran
(74) *Attorney, Agent, or Firm*—Buchanan Ingersoll & Rooney PC

(57) ABSTRACT

An image forming apparatus which has a plurality of image forming stations arranged in parallel, each of the image forming stations having a photosensitive drum, and which forms a desired image by combining toner images formed on the photosensitive drums. A laser scanning optical system deflects and scans a plurality of laser beams concurrently with a single polygon mirror to irradiate the photosensitive drums. In a monochromatic mode, the rotation speed of the photosensitive drum for forming a black image is changed higher, and synchronization of writing in a main scanning direction is performed by using one of the laser beams irradiating the other photosensitive drums of which rotation speeds are not changed.

2 Claims, 10 Drawing Sheets

IMAGE FORMING APPARATUS

This application is based on Japanese Patent Application No. 2005-342917 filed on Nov. 28, 2005, of which content is incorporated herewith by reference.

BACKGROUND OF THE INVENTION

1. Field of the Invention

The present invention relates to an image forming apparatus, and more particularly to an electrophotographic image forming apparatus for forming color images and monochromatic images, such as a copying machine and a printer, etc.

2. Description of Related Art

Electrophotographic full-color image forming apparatuses are generally of a tandem type wherein toner images of three primary colors and black are formed at respective image forming stations, each of which comprises a photosensitive drum. The toner images formed at the respective image forming stations are transferred onto an intermediate member (first transfer), and a composite image resulting from the first transfer is transferred onto a transfer member (second transfer).

In color image forming apparatuses of this type, generally, the print mode is switchable between a color mode and a monochromatic mode. A color image forming apparatus of this type comprises a scanning optical system for forming images on the photosensitive drums, and the scanning optical system scans four laser beams on the four photosensitive drums for formation of respective color images and for formation of a monochromatic image. In forming an image on each of the photosensitive drums, it is necessary to align the starting points of writing lines in a main scanning direction. For simplification, one of the laser beams is selected to be used to time the starts of writing lines with respect to image formation on all the photosensitive drums.

Japanese Patent Laid-Open Publication No. 2004-9349 (Prior Art 1) teaches that the laser beam used to form an image in a subtractive color mode (monochromatic mode) is also used for timing start of writing (for synchronization of writing) in a color mode. Also, Japanese Patent Laid-Open Publication Nos. 2001-324688 (Prior Art 2) and 11-287964 (Prior Art 3) relate to control for stabilizing a laser beam incident to a start timing sensor. These publications teach that all the laser beam emissions for synchronization of writing in the main scanning direction are controlled independently of each other.

There is a problem in a scanning optical system as disclosed by the Prior Art 1 that in accordance with the range of change in the quantity of light required for image formation, the beam emission for synchronization of writing in the main scanning direction is changeable. Also, in a scanning optical system as disclosed by the Prior Arts 2 and 3, there is a problem that beam emission for synchronization of writing and beam emission for image formation must be designed differently from each other.

SUMMARY OF THE INVENTION

An object of the present invention is to provide an image forming apparatus wherein the range of change in the quantity of light of a laser beam used for synchronization of writing in the main scanning direction is narrow and wherein control of the laser beam emission is easy.

In order to attain the object, a first aspect of the present invention relates to an image forming apparatus which comprises a plurality of image forming stations arranged in parallel, each of image forming stations having a photosensitive drum, and, which forms a desired image by combining toner images formed on the photosensitive drums. The image forming apparatus comprises a scanning optical system for deflecting and scanning a plurality of laser beams concurrently with a single deflector to irradiate the photosensitive drums. In the image forming apparatus, at least one of the photosensitive drums is controlled to change its rotation speed with a change in print mode, and in a case wherein the print mode is changed and accordingly the rotation speed of the at least one of the photosensitive drums is changed, synchronization of writing in a main scanning direction is performed by using one of the laser beams irradiating the photosensitive drums which are not used for image formation in the newly set print mode.

In the image forming apparatus according to the first aspect of the present invention, in a case wherein the print mode is changed and accordingly the rotation speed of the at least one of the photosensitive drums (the system speed) is changed, synchronization of writing in a main scanning direction is performed by using one of the laser beams irradiating the photosensitive drums which are not used for image formation in the newly set print mode. Accordingly, it is not necessary to change the gain of a sensor for generating synchronization signals. Also, the quantity of light for synchronization of writing and the quantity of light for image formation do not need to be different from each other, that is, the beam used for synchronization of writing can have the same quantity of light as that for image formation. Further, the quantity of light incident to the synchronization sensor changes merely within a narrow range. Thus, emission control is easy, and it is possible to obtain images of high quality.

In the image forming apparatus according to the first aspect of the present invention, it is preferred that the laser beam used for synchronization of writing is a laser beam of which quantity of light is required to change within a narrow range. Also, the laser beam used for synchronization of writing is preferably the laser beam entering to the deflector at the smaller incident angle of the laser beams which are obliquely incident to the deflector. Thereby, the jitter caused by errors in perpendicularity of the reflective surfaces of the deflector can be suppressed.

In the monochromatic mode, the laser beam used for synchronization of writing in the main scanning direction is the laser beam irradiating one of the photosensitive drums used for forming a color image in the color mode, and the photosensitive drum exposed to the laser beam is preferably rotated from a start of the laser beam emission to generation of a first synchronization. This minimizes degradation of the photosensitive drum.

In the monochromatic mode, alternatively, the laser beam used for synchronization of writing in the main scanning direction is one of the laser beams irradiating the photosensitive drums for formation of a color image, and a light source of the laser beam does not perform bias emission. This minimizes degradation of the light source and degradation of the photosensitive drum exposed to the laser beam.

The second aspect of the present invention relates to an image forming apparatus which comprises a plurality of image forming stations arranged in parallel, each of image forming stations having a photosensitive drum, and which forms a desired image by combining toner images formed on the photosensitive drums. The image forming apparatus comprises a scanning optical system for deflecting and scanning a plurality of laser beams concurrently with a single deflector to irradiate the photosensitive drums, and at least two laser beams are scanned in parallel on one of the photosensitive drums for forming a monochromatic image. In the image forming apparatus, both in a color mode and in a monochromatic mode, one of the at least two laser beams is used for synchronization of writing in a main scanning direction.

In the image forming apparatus according to the second aspect of the present invention, both in the color mode and in the monochromatic mode, one of the at least two laser beams is used for synchronization of writing. Thereby, it is not necessary to change the gain of a sensor for generating synchronization signals. Also, the quantity of light for synchronization of writing and the quantity of light for image formation do not needs to be different from each other, that is, the laser beam used for synchronization of writing can have the same quantity of light as that for image formation. Further, the quantity of light incident to the synchronization sensor changes merely within a narrow range. Therefore, emission control is easy, and images of high quality can be obtained.

BRIEF DESCRIPTION OF THE DRAWINGS

This and other objects and features of the present invention will be apparent from the following description with reference to the accompanying drawings, in which:

FIG. 8 is a flowchart showing a main routine carried out when the power is turned on;

DETAILED DESCRIPTION OF THE PREFERRED EMBODIMENTS

Preferred embodiments of the present invention are described with reference to the accompanying drawings.

General Structure of Image Forming Apparatus; See FIG. 1

Figure 1:
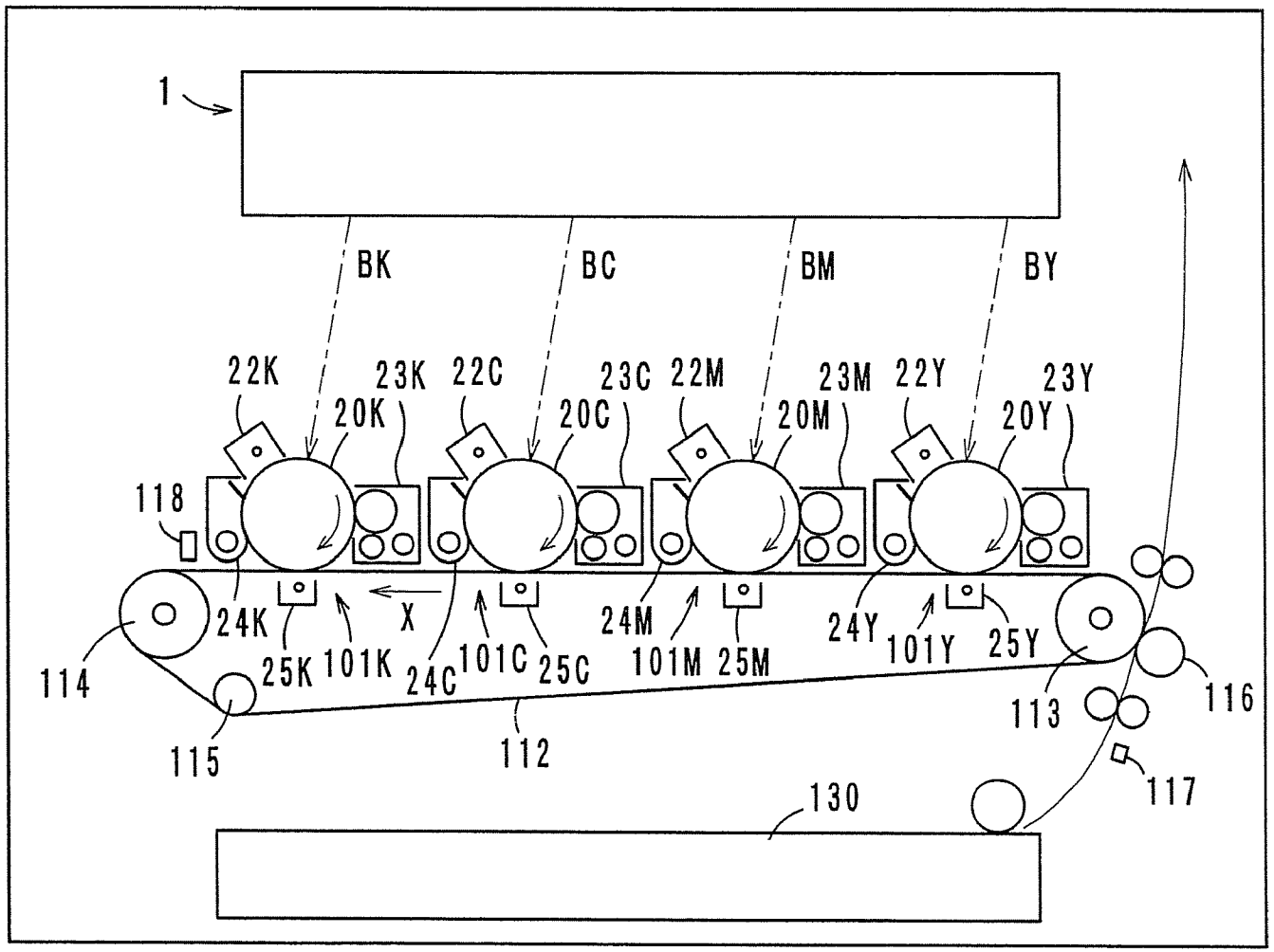
FIG. 1 is a general structural view of an image forming apparatus according to a first embodiment of the present invention.

An image forming apparatus shown by FIG. 1 is an electrophotographic color printer of a tandem type, wherein images of four colors (y: yellow, M: magenta, C: cyan and K: black) are combined.

The image forming apparatus is generally described. Image forming stations 101 (101Y, 101M, 101C and 101K) respectively comprising photosensitive drums 20 (20Y, 20M, 20C and 20K) are arranged in parallel, and the photosensitive drums 20 are driven to rotate by motors 21 (21Y, 21M, 21C and 21K; see FIG. 5) respectively. At the image forming stations 101, electric chargers 22 (22Y, 22M, 22C and 22K), developing devices 23 (23Y, 23M, 23C and 23K) and residual toner cleaners 24 (24Y, 24M, 24C and 24K) are provided.

Above the image forming stations 101, a laser beam scanning optical system 1 is provided, and four laser beams BY, BM, BC and BK irradiate the respective photosensitive drums 20 to form images. Immediately under the image forming stations 101, an intermediate transfer belt 112 is endlessly bridged among rollers 113, 114 and 115. The intermediate transfer belt 112 is driven to rotate in direction "X". A second transfer roller 116 is provided opposite the driving roller 113 with the intermediate transfer belt 112 between the rollers 116 and 113. First transfer chargers 25 (25Y, 25M, 25C and 25K) are provided opposite the respective photosensitive drums 20, behind the intermediate transfer belt 112. Further, in a lower level of the image forming apparatus, an automatic feeding section 130 is provided, and transfer materials in a stack are fed one by one.

YMCK image data are sent to an image memory 34 (see FIG. 5) from an image reading device (scanner), a computer or the like. In accordance with the image data, the laser scanning optical system 1 is driven so as to form toner images on the photosensitive drums 20. This electrophotographic process is well known, and a description thereof is omitted.

While the intermediate transfer belt 112 is rotating in direction "X", the toner images formed on the photosensitive drums 20 are transferred sequentially onto the intermediate transfer belt 112 by electric fields excited by the first transfer chargers 25 (first transfer). Thereby, the images of the four colors are combined, and a composite image is formed. In the meantime, a transfer member is fed upward from the feeding section 130, and the composite image is transferred from the intermediate transfer belt 112 onto the transfer member by an electric field excited by the transfer roller 116 (second transfer). Thereafter, the transfer member is fed to a fixing device, where the toner on the transfer member is fixed thereon by heat, and is ejected onto an upper surface of the image forming apparatus.

Immediately before the second transfer position, a TOD sensor 117 for detecting a fed transfer member is provided to synchronize further feeding of the transfer member with travel of the image on the intermediate transfer belt 112. Also, in order to detect the image on the intermediate transfer belt 112, a register sensor 118 is provided. Register correction images are formed on the intermediate transfer belt 112 at the respective image forming stations 101, and the register correction images are detected by the sensor 118. The times of laser beam emissions BY, BM, BC and BK are adjusted in accordance with the detections of the register correction images, so that YMCK images can be laid exactly one upon another on the transfer belt 112.

Laser Scanning Optical System; See FIGS. 2-4

Figure 2:
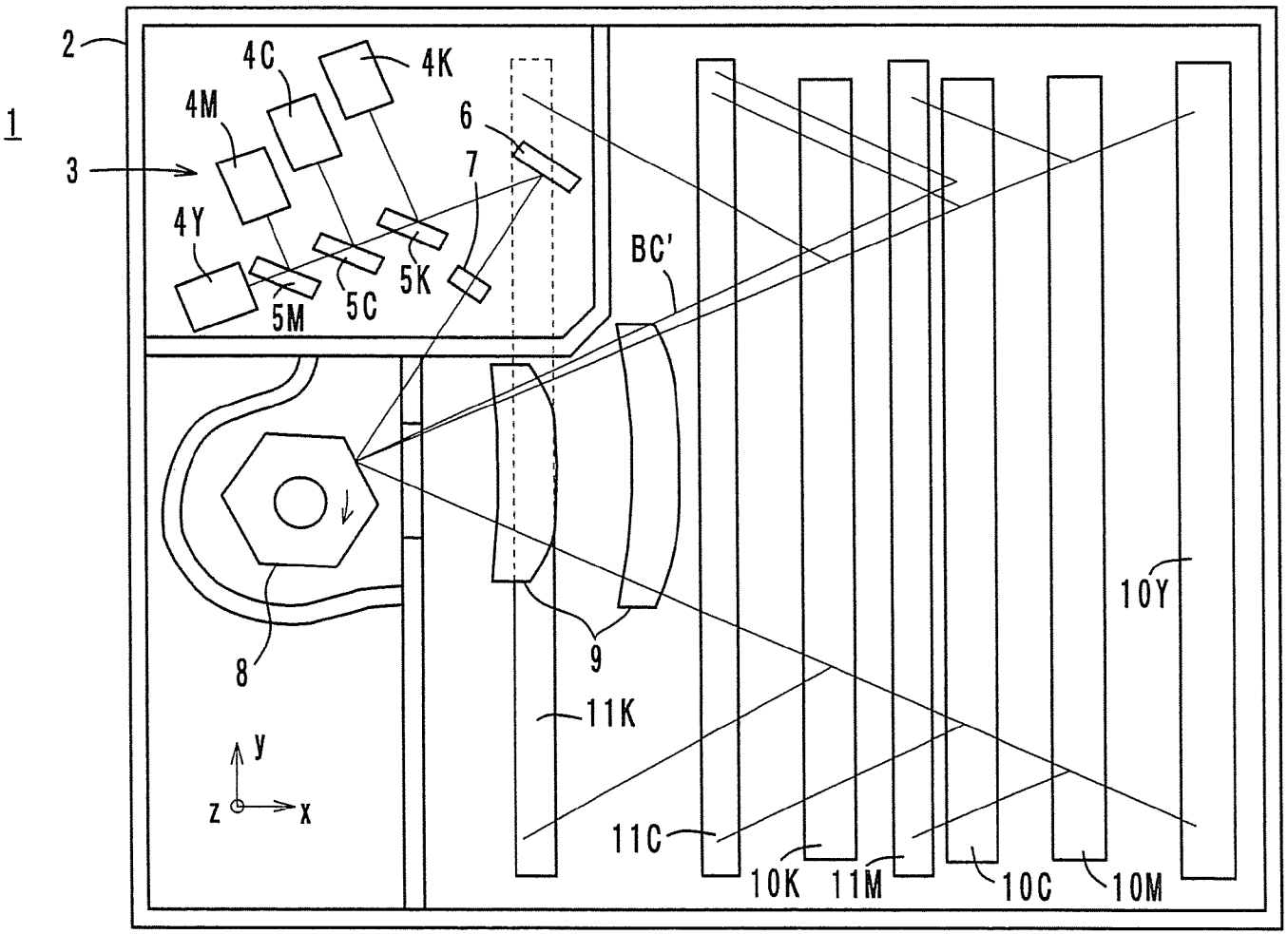
FIG. 2 is a plan view of a laser scanning optical system provided for the image forming apparatus.
Figure 3:
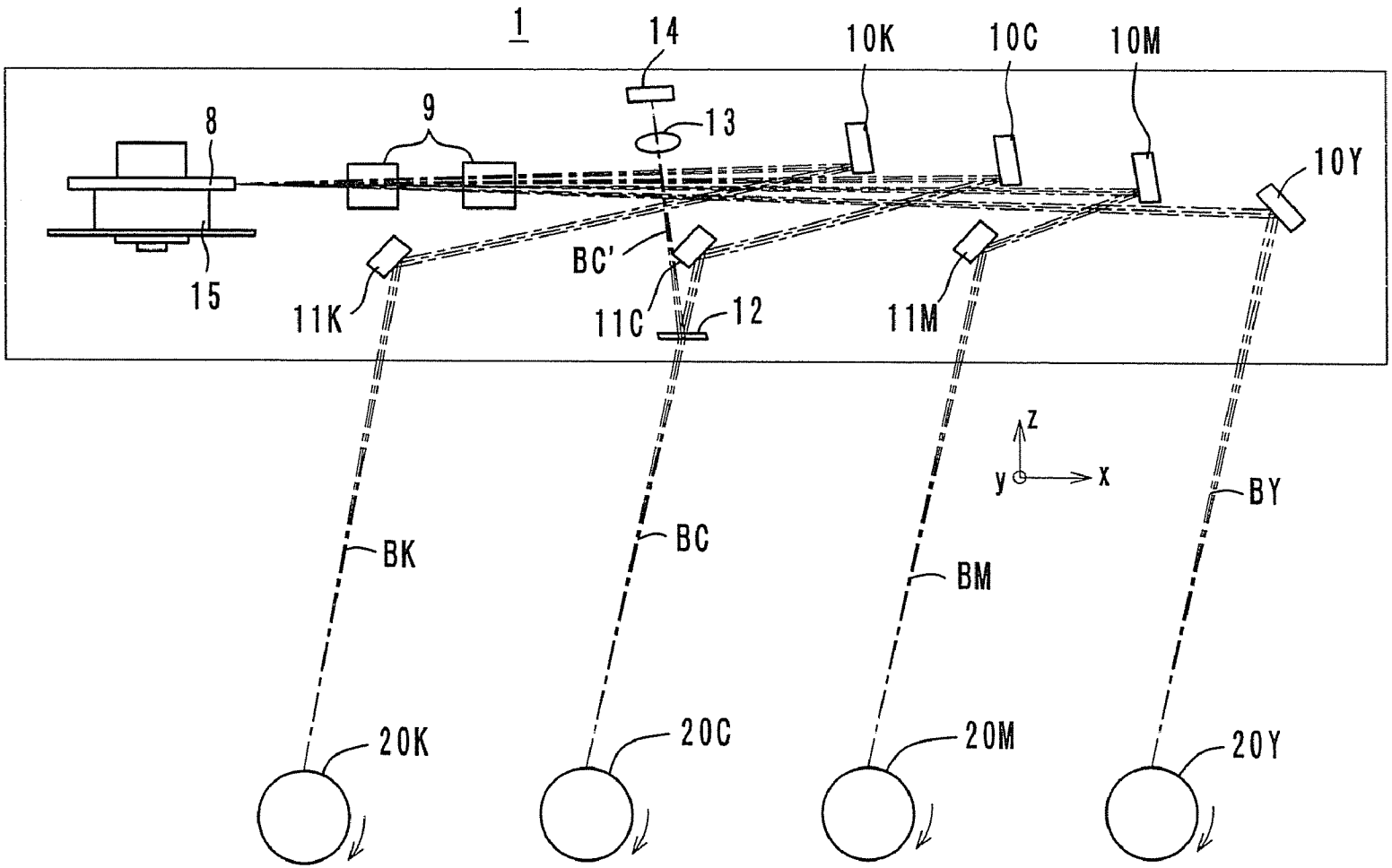
FIG. 3 is an elevation view of the laser scanning optical system showing the general structure thereof.

As FIGS. 2 and 3 show, the laser scanning optical system 1 emits laser beams BY, BM, BC and BK to the photosensitive drum 20Y, 20M, 20C and 20K respectively so as to form images of the respective four colors.

The laser scanning optical system 1 comprises a light source unit 3, a polygon mirror 8 driven to rotate by a motor 15, a lens system 9 composed of two lenses and plane mirrors 10Y, 10M, 11M, 10C, 11C, 10K and 11K. Further, in order to synchronize start of writing in the main scanning direction, an SOS sensor 14, a plane mirror 12 and a convergent lens 13 are provided. The plane mirror 12 and the convergent mirror 13 are to direct a beam BC' diverging from the laser beam BC, which is to form a cyan image, to the SOS sensor 14. These optical elements are encased in a housing 2.

The light source unit 3 comprises laser diodes 4 (4Y, 4M, 4C and 4K), plane mirrors 5 (5Y, 5M, 5C and 5K), a plane mirror 6 and a cylindrical lens 7. The laser diodes 4 emit laser beams respectively, and if necessary, the laser beams are converted into parallel lights by collimator lenses (not shown). The laser beams are reflected by the plane mirrors 5 and 6, and are converged in a sub-scanning direction "z" by the cylindrical lens 7. Then, the laser beams are directed to the polygon mirror 8.

The laser beams are deflected in the main scanning direction "y" at a constant angular velocity by rotation of the polygon mirror 8. The deflected laser beams pass through the scanning lens system 9. Thereby, the laser beams obtain an fθ characteristic, and aberrations are corrected. Then, the laser beams travel through respective optical paths composed of the optical elements thereafter and are imaged on the respective photosensitive drums 20.

Figure 4:
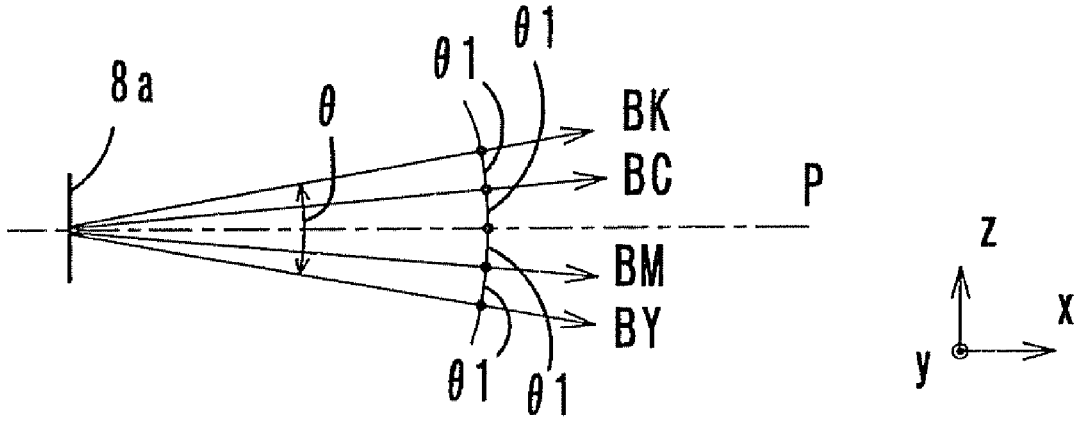
FIG. 4 is an illustration of oblique incidence of laser beams entering to a polygon mirror in the laser scanning optical system.

As FIG. 4 shows, the four laser beams BY, BM, BC and BK are obliquely incident to reflective surfaces 8*a* of the polygon mirror 8 concurrently at different angles pitched by θ1 to the optical axis P in the sub-scanning direction "z". The four beams are deflected in the main scanning direction "y" and pass through the scanning lens system 9 concurrently. In this embodiment, the beam BC located in the center part of the four beams is used to synchronize start of writing of the four beams, and thereby, jitter caused by errors in perpendicularity of the reflective surfaces 8*a* of the polygon mirror 8 can be inhibited. Further, the incident angles of the four beams in the sub-scanning direction "z" are not necessarily spaced by θ1, and the incident angles may be designed to be at uneven intervals.

Control Section; See FIG. 5

Figure 5:
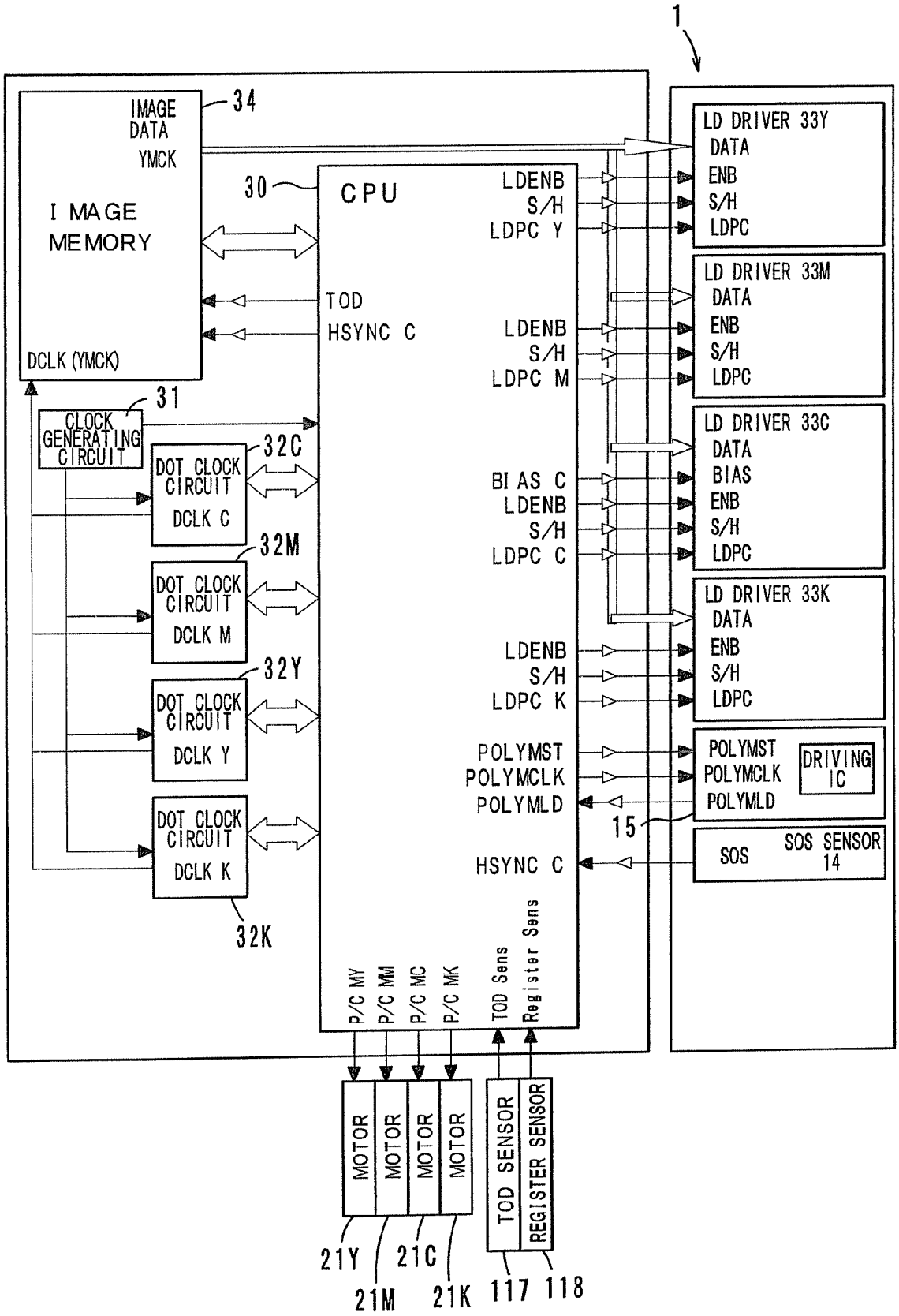
FIG. 5 is a block diagram of a control section.

Next, referring to FIG. 5, a control section of the image forming apparatus is described. The control section generally comprises a CPU 30, a driving clock generating circuit 31 and an image memory 34. The CPU 30 controls a polygon motor 15. Every time the beam BC' is incident to the SOS sensor 14, the beam BC' is photo-electrically converted into a main scanning synchronizing signal HSYNC C, and the signal HSYNC C is input to the CPU 30. The CPU 30 also receives a transfer material detection signal from the TOD sensor 17 and correction image detection signals from the register sensor 118. The CPU 30 calculates register correction values, for example, on the positions of images in the main scanning direction, on the positions of images in the sub-scanning direction, on the magnification in the main scanning direction, etc. based on the detection signals from the register sensor 118. Further, the CPU 30 controls emission of the laser diodes 4 for obtaining SOS signals to be sent to the photosensitive drums 20 and emission of the laser diodes 4 for forming correction images.

The image memory 34 receives the main scanning synchronizing signals HSYNC C and an image request signal TOD. The image memory 34 incorporates a plurality of sub-scanning counters and starts counting the synchronizing signals HSYNC C triggered by the signal TOD. While register in the sub-scanning direction and register in the main scanning direction are performed in this way, YMCK image data are sent to LD drivers 33Y, 33M 33C and 33K. Thus, the data sending is performed at times calculated from the results of the register correction.

Further, the CPU 30 controls driving motors 21Y, 21M, 21C and 21K of the respective photosensitive drums 20 and controls whether the LD driver 33C performs bias emission for obtaining synchronizing signal. The CPU 30 also controls the quantities of light of the respective colors and controls every device and member in the image forming apparatus.

In the image forming apparatus, in a color mode, the photosensitive drums 20 are rotated at a specified system speed A, and in a monochromatic mode, the photosensitive drum 20K is rotated at another specified system speed aA (2>a>1). Accordingly, when a change between the color mode and the monochromatic mode is made, that is, when the system speed and the modulation frequency are changed, the CPU 30 changes the number of revolutions of the polygon motor 15, the number of revolutions of the photosensitive drum driving motors 21Y, 21M, 21C and 21K and the image forming area.

With respect to the LD drivers 33Y, 33M, 33C and 33K, there is a linear correlation function between the charged amounts in the capacitors provided for the LD drivers and the respective LD driving currents, and it takes several, milliseconds to charge the capacitors to a specified amount.

First Embodiment of Scanning Synchronization

In the first embodiment, both in the color mode and in the monochromatic mode, the laser beam BC for forming a cyan image is partly directed to the SOS sensor 14 so as to obtain main scanning synchronization signals. The range of change in the quantity of light on the light receiving surface of the SOS sensor 14 is described referring to Tables 1A and 1B below.

TABLE 1A

BEAM USED FOR SYNCHRONIZATION OF WRITING = BK (COMPARATIVE CASE)

| | BEAM | COLOR MODE SYSTEM SPEED A | MONOCHROMATIC MODE SYSTEM SPEED aA (2 > a > 1) | RANGE OF CHANGE IN QUANTITY OF LIGHT ON SOS SENSOR |
|---|---|---|---|---|
| COLOR MODE | BY | 0.25B~1.0B | | |
| | BM | 0.25B~1.0B | | |
| | BC | 0.5B~1.0B | | |
| MONOCHROMATIC MODE | BK (USED FOR SYNCHRONIZATION) | 0.25B~1.0B | 0.25aB~1.0aB | 0.25aBD~1.0aBD |

TABLE 1B

| BEAM USED FOR SYNCHRONIZATION OF WRITING = BC (FIRST EMBODIMENT) | | | | |
|---|---|---|---|---|
| | BEAM | COLOR MODE SYSTEM SPEED A | MONOCHROMATIC MODE SYSTEM SPEED aA (2 > a > 1) | RANGE OF CHANGE IN QUANTITY OF LIGHT ON SOS SENSOR |
| COLOR MODE | BY | 0.25B~1.0B | | |
| | BM | 0.25B~1.0B | | |
| | BC (USED FOR SYNCHRONIZATION) | 0.5B~1.0B | FIXED VALUE WITHIN 0.5B~1.0B | 0.5BD~1.0BD |
| MONOCHROMATIC MODE | BK | 0.25B~1.0B | 0.25aB~1.0aB | |

The system speed in the color mode is A, and the system speed in the monochromatic mode is aA (2>a>1). The quantity of light on each of the photosensitive drums 20 and the quantity of light on the light receiving surface of the SOS sensor 14 is at a ratio of 1:D.

Table 1A shows a comparative case wherein the beam BK for forming a black image is used to obtain synchronization signals. When the quantity of light required on the photosensitive drum is within a range from 0.5B to 1.0B, the quantity of light on the light receiving surface of the SOS sensor changes within a range 0.5BD to 1.0BD. Here, "B" is an arbitrary coefficient, and "0.5B" is a required quantity of light on each of the photosensitive drums in the initial state. As the photosensitive drums are being used, the photosensitive layers thereof are abraded, and the photosensitivity becomes lower. In order to comply with this change, the quantity of light irradiating the photosensitive drums must be heightened gradually. Therefore, the quantity of light on the photosensitive drums must be changed within a certain range.

In the monochromatic mode, the system speed is aA, and when the quantity of light required on the photosensitive drum is within a range from 0.5B to 1.0B, the quantity of light on the light receiving surface of the SOS sensor changes within a range from 0.5aBD to 1.0aBD. Thus, the range of change in the quantity of light on the SOS sensor in the monochromatic mode is wider than that in the color mode. In this case, it is necessary to provide a mechanism for switching a gain from the SOS sensor and a mechanism for changing the output of the LD driver to change the quantity of light to obtain synchronization signals and the quantity of light to form an image for several microseconds.

Table 1 B shows the first embodiment wherein the beam BC for forming a cyan image is used to obtain synchronization signals both in the color mode and in the monochromatic mode. In the monochromatic mode, the beam BC is not used to form an image and needs to be controlled only to perform emission to obtain synchronization signals. Also, the range of change in the quantity of light on the light receiving surface of the SOS sensor is not influenced by the change in the system speed, and the range of change in the quantity of light on the light receiving surface of the SOS sensor in the monochromatic mode is from 0.5BD to 1.0BD, which is the same as in the color mode.

When the print mode is changed, the rotation speed of the photosensitive drum 20C is not changed while the rotation speed of the photosensitive drum 20K is changed. In the first embodiment, the laser beam BC which irradiates the photosensitive drum 20C is used to obtain synchronization signals in the main scanning direction, and the range of change in the quantity of light entering to the SOS sensor is inhibited within a specified narrow range. This facilitates emission control and permits formation of images of high quality. Thus, in order to narrow the range of change in the quantity of light entering into the SOS sensor, it is advantageous to use the beam BC to obtain synchronization signals because the range of change in the quantity of light of the beam BC required for image formation in the color mode is narrower than that of the beam BK required for image formation in the monochromatic mode.

Printing Start Time at Startup of Color Mode; See FIG. 6

Figure 6:
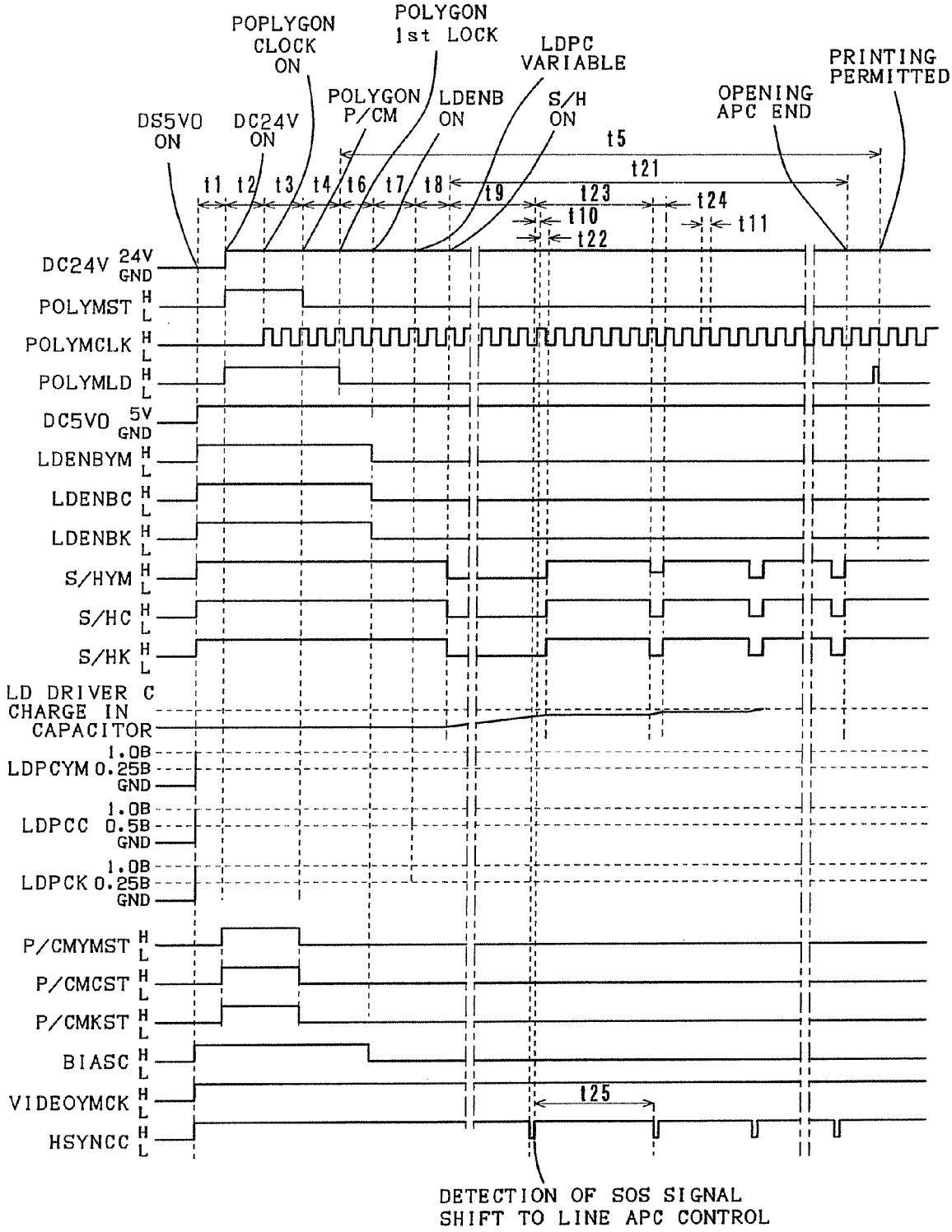
FIG. 6 is a chart showing a time of starting printing in a color mode.

FIG. 6 shows how to time the start of printing at startup of the color mode in the first embodiment. More specifically, FIG. 6 shows startup of the polygon motor, the photosensitive drums and the LD driver, which are designed to operate at the system speed A.

Printing Start Time at Startup of Monochromatic Mode; See FIG. 7

Figure 7:
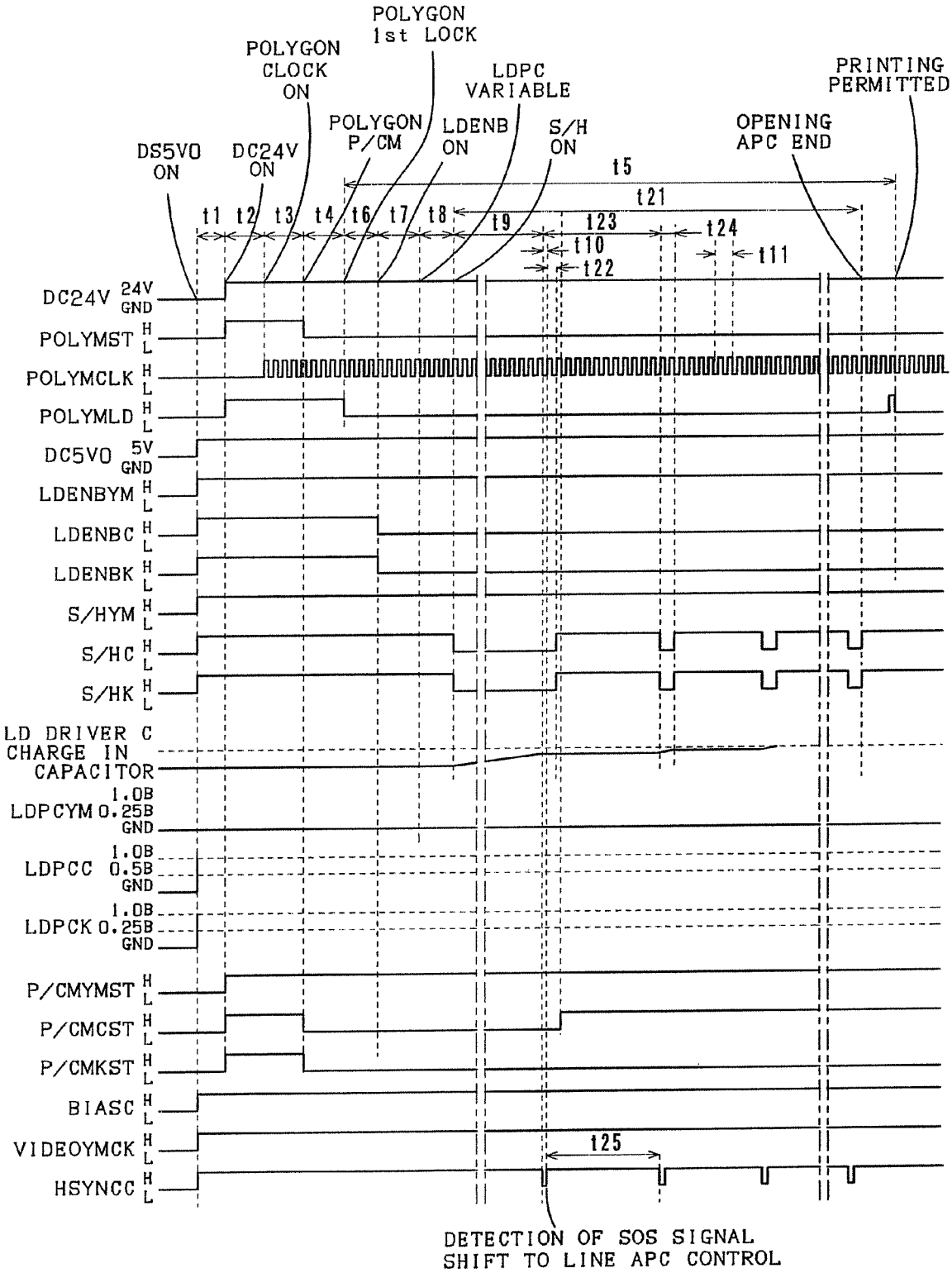
FIG. 7 is a chart showing a time of starting printing in a monochromatic mode.

FIG. 7 shows how to time the start of printing at startup of the monochromatic mode in the first embodiment. More specifically, FIG. 7 shows startup of the polygon motor, the photosensitive drums and the LD driver, which are designed to operate at the system speed aA.

The differences from the startup of the color mode are described. The frequency of a signal POLY M CLK is a times that in the color mode. The photosensitive drums 20Y and 20M are not operated, and a signal LDPC C relating to the quantity of light of the laser beam used to obtain synchronization signals is fixed at a value between 0.5B and 1.0B.

A signal P/CM is stopped when a synchronization signal HSYNC C is detected. When a signal S/H C becomes a sample state, charging of the capacitor provided for the LD driver 33C starts, and the quantity of light output therefrom becomes higher gradually. When the quantity of light becomes high enough to be detected by the SOS sensor, a synchronization signal HSYNC C is output. Until then, a timer for controlling image writing in the main scanning direction has been inactive, and the photosensitive drum 20C has been exposed to the light. If the photosensitive drum 20C was stopped for that period, the laser beam would continue irradiating the same line on the photosensitive drum 20C for the period, which would result in degradation of only the part on the exposed line of the photosensitive drum 20C. In order to avoid this trouble, the photosensitive drum 20C is rotated until the output of the synchronization signal HSYNC C.

Also, a signal BIAS C is not activated, and thereby, the laser diode which emits the beam to obtain synchronization signals does not perform bias emission. Not supplying a bias current to the laser diode causes a delay of several nanometers in switching the laser diode. However, emission to obtain the synchronization signal SYMC C lasts for a sufficiently long time, e.g., several microseconds, and practically, switching of the laser diode is not influenced by an absence of a bias current.

Control Procedure; See FIGS. 8 and 9

Figure 8:
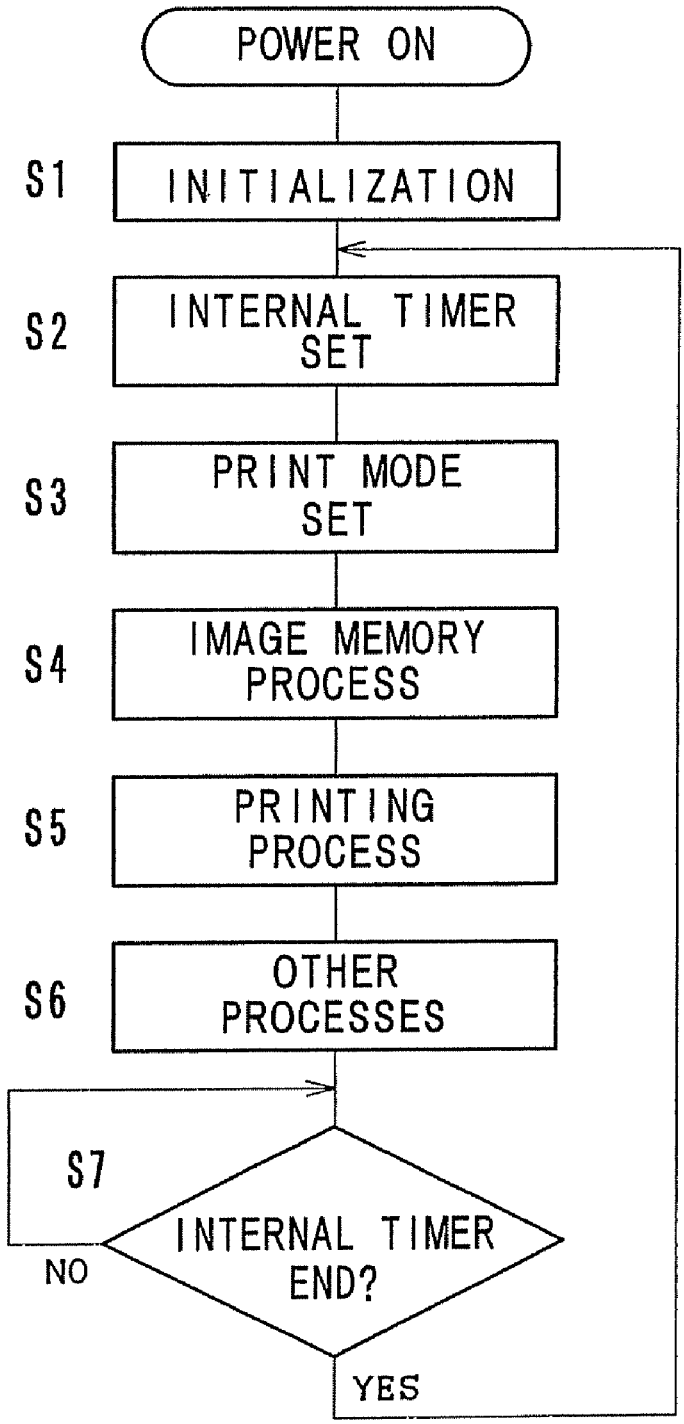

FIG. 8 shows a main routine carried out by the CPU 30 when the image forming apparatus is turned on. After a power-on, first, a RAM, timers and various parameters of the CPU 30 are initialized at step S1. Next, an internal timer for determining the length of one routine is set at step S2, and a printing mode is set at step S3.

Figure 10:
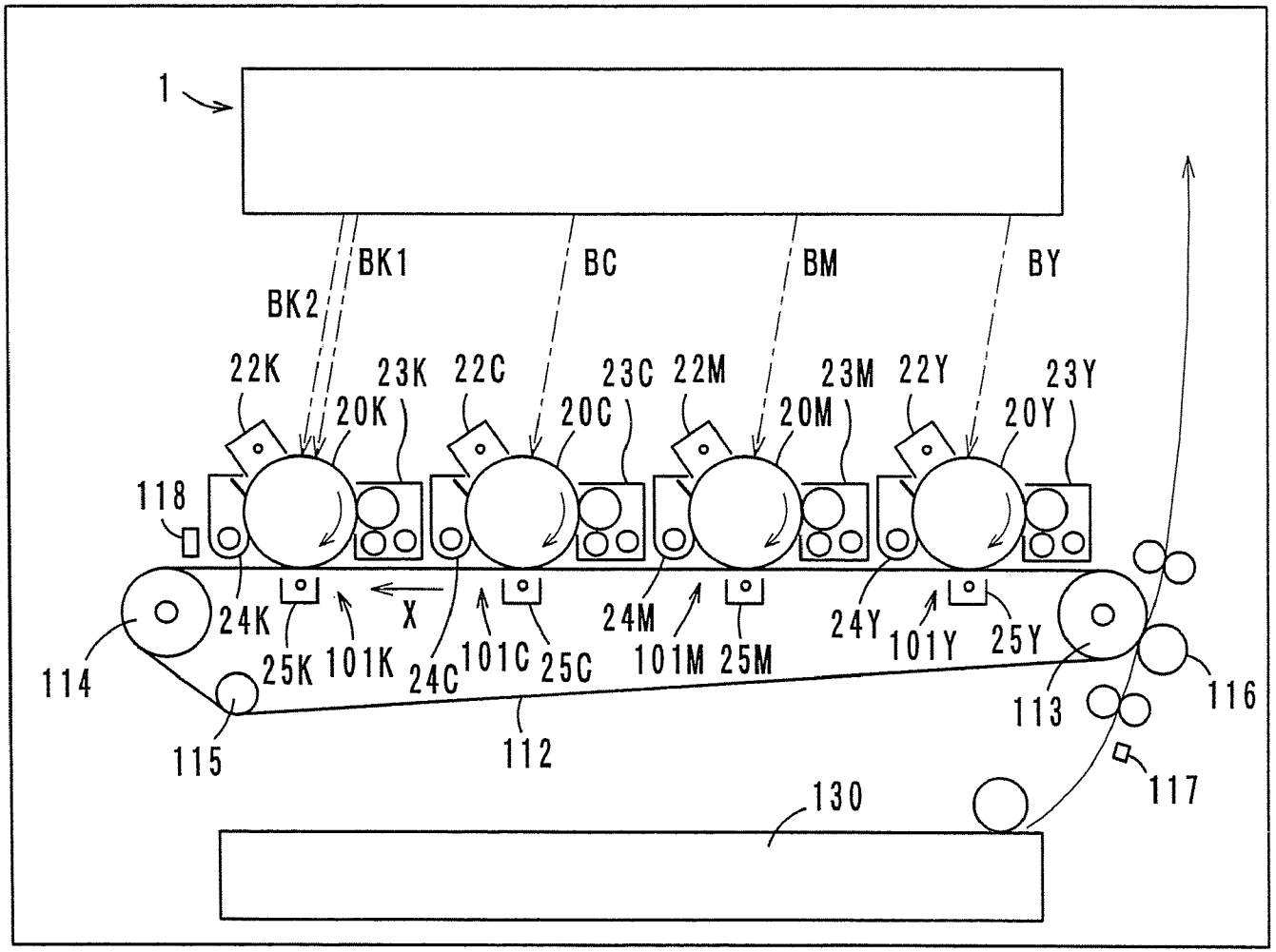
FIG. 10 is a general structural view of an image forming apparatus according to a second embodiment of the present invention.

Next, a request for image data is sent to a controller at step S4, and printing is performed at step S5. Other processes such as paper jam detection, etc. are performed at step S6, and when the internal timer ends (YES at step S7), the program goes back to step S2.

embodiment, two laser beams BK1 and BK2 are scanned in parallel with a gap of 14 μm in-between in the sub-scanning direction to form a black image in the monochromatic mode. In the color mode, the laser beam BK1 is used for image formation, while the laser beam BK2 is not used for image formation. Both in the color mode and in the monochromatic mode, the laser beam BK2 is used to obtain synchronization signals. The image forming apparatus shown by FIG. 10 is of the same structure as the image forming apparatus shown by FIG. 1, except for the point that two beams BK1 and BK2 are provided to form black images. The range of change in the quantity of light on the light receiving surface of the SOS sensor in the second embodiment is described referring to Table 2A and Table 2B below.

TABLE 2A

BEAM USED FOR SYNCHRONIZATION OF WRITING = BK1 (COMPARATIVE CASE)

| | BEAM | COLOR MODE SYSTEM SPEED A | MONOCHROMATIC MODE SYSTEM SPEED aA (2 > a > 1) | RANGE OF CHANGE IN QUANTITY OF LIGHT ON SOS SENSOR |
|---|---|---|---|---|
| COLOR MODE | BY<br>BM<br>BC | | | |
| MONOCHROMATIC MODE | BK1 (USED FOR SYNCHRONIZATION)<br>BK2 | 0.5B~1.0B | 0.5 × 0.5aB~1.0 × 0.5aB | 0.25aBD~1.0aBD |

TABLE 2B

BEAM USED FOR SYNCHRONIZATION OF WRITING = BK2 (SECOND EMBODIMENT)

| | BEAM | COLOR MODE SYSTEM SPEED A | MONOCHROMATIC MODE SYSTEM SPEED aA (2 > a > 1) | RANGE OF CHANGE IN QUANTITY OF LIGHT ON SOS SENSOR |
|---|---|---|---|---|
| COLOR MODE | BY<br>BM<br>BC | | | |
| MONOCHROMATIC MODE | BK1<br>BK2 (USED FOR SYNCHRONIZATION) | 0.5B~1.0B<br>FIXED VALUE WITHIN 0.5 × 0.5aB~1.0 × 0.5aB | 0.5 × 0.5aB~1.0 × 0.5aB | 0.25aBD~1.0aBD |

Figure 9:
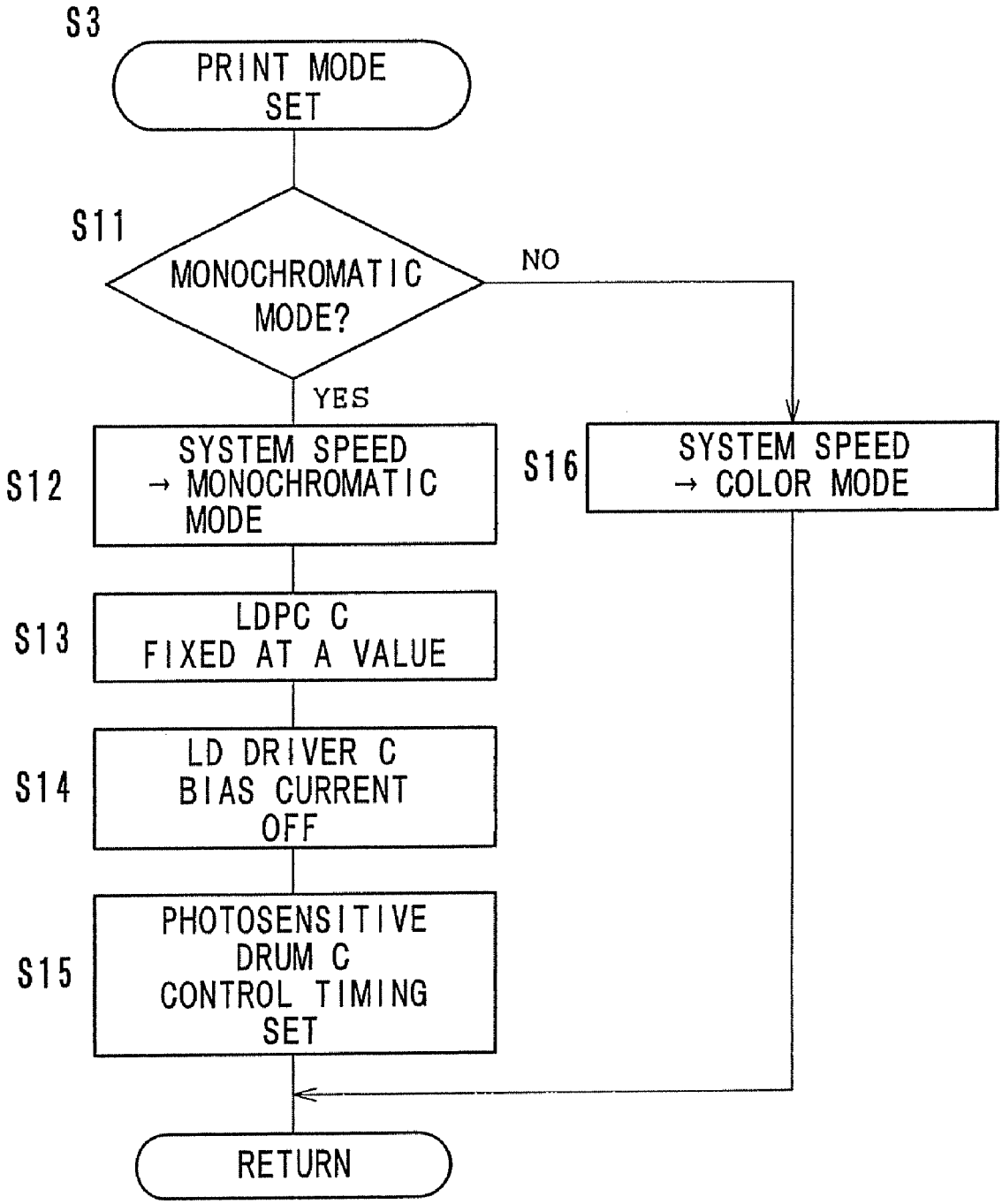
FIG. 9 is a flowchart showing a sub-routine for setting a print mode.

FIG. 9 shows a sub routine for setting a printing mode carried out at step S3 of the main routine. When the monochromatic mode is selected (YES at step S11), the system speed is set to a speed for monochromatic mode at step S12, and the quantity of light LDPC C of the laser diode 4C used to obtain synchronization signals is set to a value at step S13. The bias current supplied to the LD driver 33C for the laser diode 4C is set to be off at step S14, and the photosensitive drum 20C is set to be rotated until detection of a synchronization signal HSYNC C at step S15. Then, the program returns to the main routine.

On the other hand, when the color mode is selected (NO at step S11), the system speed is set to a speed for color mode at step S16. Then, the program returns to the main routine.

Second Embodiment of Writing Synchronization

FIG. 10 shows an image forming apparatus according to a second embodiment of the present invention. In the second The system speed in the color mode is A, and the system speed in the monochromatic mode is aA (2>a>1). The quantity of light on each of the photosensitive drums and the quantity of light on the light receiving surface of the SOS sensor is at a ratio of 1:D.

Table 2A shows a comparative case wherein the beam BK1 is used to obtain synchronization signals both in the color mode and in the monochromatic mode. When the quantity of light required on each of the photosensitive drums is within a range from 0.5B to 1.0B, in the color mode, the quantity of light on the light receiving surface of the SOS sensor changes within 0.5BD to 1.0BD. In the monochromatic mode, both of the two beams BK1 and BK2 are used to form black images, and the system speed is aA. Accordingly, in the monochromatic mode, the quantity of light of each of the laser beams BK1 and BK2 is within a range from 0.25aB to 0.5aB, and the quantity9 of light on the light receiving surface of the SOS sensor is within a range from 0.25aBD to 0.5aBD. Consequently, the quantity of light on the light receiving surface of the SOS sensor changes within a range from 0.25aBD to 1.0aBD, that is, the range of change in the quantity of light on the SOS sensor is wide. If the range of change in the quantity of light on the SOS sensor is so wide, it is necessary to provide a mechanism for switching a gain from the SOS sensor and a mechanism for changing the output of the LD driver for several microseconds between a value to obtain synchronization signals and a value to form an image.

Table 2B shows the second embodiment wherein the beam BK2 is used to obtain synchronization signals both in the color mode and in the monochromatic mode. In the color mode, the beam BK2 is not used to form an image and needs to be controlled only to perform emission to obtain synchronization signals. Both in the color mode and in the monochromatic mode, the quantity of light of the laser beam BK2 is within a range from 0.25aB to 0.5aB, and the quantity of light on the light receiving surface of the SOS sensor is within a range from 0.25aBD to 0.5aBD.

Thus, in the second embodiment, the two beams BK1 and BK2 are scanned in parallel only in the monochromatic mode, and the beam BK2 is used to obtain synchronization signals both in the color mode and in the monochromatic mode. Thereby, the range of change in the quantity of light entering to the SOS sensor is inhibited within a specified narrow range. This facilitates emission control and permits formation of images of high quality.

Other Embodiments

Image forming apparatuses according to the present invention are not limited to the above-described embodiments, and various changes and modifications are possible to those who are skilled in the art. The structure of the image forming stations and the structure of the control section may be arbitrarily designed.

What is claimed is:

1. An image forming apparatus which comprises a plurality of image forming stations arranged in parallel, each of image forming stations having a photosensitive drum, and which forms a desired image by combining toner images formed on the photosensitive drums, said image forming apparatus comprising:

a scanning optical system for deflecting and scanning a plurality of laser beams concurrently with a single deflector to irradiate the photosensitive drums, wherein:

at least two laser beams are scanned in parallel on one of the photosensitive drums for forming a monochromatic image; and both in a color mode and in a monochromatic mode, one of the at least two laser beams is used for synchronization of writing in a main scanning direction.

2. An image forming apparatus according to claim 1, wherein:

in the monochromatic mode, the at least two laser beams are used to form a monochromatic image; and in the color mode, the laser beam which is not used for synchronization of writing is used to form a color image.

* * * * *